US006655900B1

(12) United States Patent
Knutson

(10) Patent No.: US 6,655,900 B1
(45) Date of Patent: Dec. 2, 2003

(54) SKID LOADER ATTACHMENT

(76) Inventor: Kenneth Knutson, R.R. 2 Box 67, Toronto, SD (US) 57268

( * ) Notice: Subject to any disclaimer, the term of this patent is extended or adjusted under 35 U.S.C. 154(b) by 33 days.

(21) Appl. No.: 09/922,296

(22) Filed: Aug. 3, 2001

Related U.S. Application Data

(60) Provisional application No. 60/225,371, filed on Aug. 14, 2000.

(51) Int. Cl.[7] ..... B66C 1/00

(52) U.S. Cl. ..... 414/729; 414/607; 414/659; 414/912; 294/67.22

(58) Field of Search ..... 414/607, 659, 414/660, 661, 729, 912; 294/67.2, 67.22, 104, 3; 37/405, 406

(56) References Cited

U.S. PATENT DOCUMENTS 3,348,715 A * 10/1967 Kretz ..... 414/724 X
5,639,205 A * 6/1997 Kaczmarczyk ..... 414/723
5,779,430 A * 7/1998 Ball ..... 414/724
6,109,859 A * 8/2000 Domann ..... 294/67.22 X
6,168,369 B1 * 1/2001 Bright et al. ..... 414/724

* cited by examiner

*Primary Examiner*—Donald W. Underwood
(74) *Attorney, Agent, or Firm*—Kaardal & Leonard, LLP

(57) ABSTRACT

A skid loader attachment for increasing the versatility and ease of use of the skid loader. The skid loader attachment includes a frame assembly having a base portion. The base portion is designed for coupling to booms of a skid loader. The frame assembly has a plurality of tines. The tines forwardly extend from the base portion of the frame assembly opposite the skid loader. A plurality of arm assemblies are coupled to the base portion of the frame assembly. Each of the arm assemblies are articulated such that each of the arm; assemblies is positionable with respect to the frame assembly. Each of the arm assemblies are adapted for being operationally coupled to the skid loader such that articulation of each of the arm assemblies is controlled by an operator of the skid loader. The arm assemblies are adapted for facilitating manipulation of materials engaged by said frame assembly.

27 Claims, 12 Drawing Sheets

SKID LOADER ATTACHMENT

CROSS REFERENCE TO RELATED APPLICATIONS

This application claims the benefit of U.S. Provisional Application No. 60/225,371, filed Aug. 14, 2000.

BACKGROUND OF THE INVENTION

1. Field of the Invention

The present invention relates to buckets for skid loaders and more particularly pertains to a new skid loader attachment for increasing the versatility and ease of use of the skid loader.

2. Description of the Prior Art

The use of buckets for skid loaders is known in the prior art. More specifically, buckets for skid loaders heretofore devised and utilized are known to consist basically of familiar, expected and obvious structural configurations, notwithstanding the myriad of designs encompassed by the crowded prior art which have been developed for the fulfillment of countless objectives and requirements.

The prior art buckets provide the limitation that buckets can only be dumped into containers that are equal to or less than the height from the ground to the connection between the booms of the skid loader and the bucket in a fully raised position. This is due to the fact the bucket is required-to be pivoted downward to empty the materials into the container. The applicant's skid loader attachment permits the frame assembly to remain extend to its full height while using the arm assemblies and attachment assembly to push material from the bucket portion into the container without the need to tip the frame assembly forward to empty the bucket portion. Thus the skid loader with the applicant's skid loader attachment could utilize a conventional sized dump truck which is not feasible with prior art buckets for skid loaders.

The prior art buckets for skid loaders are inconvenient for hauling materials such as pipes and hay bales in that the operator or coworker is required to get dangerously close to the bucket and material to secure the material to the bucket. The applicant's skid loader attachment permits the operator of the skid loader to use the arm assemblies to secure the material to the frame assembly from the safety of the protective cage of the skid loader.

While buckets for skid loaders fulfill their respective, particular objectives and requirements, they do not disclose a new skid loader attachment. The inventive device includes a frame assembly having a base portion. The base portion is designed for coupling to booms of a skid loader. The frame assembly has a plurality of tines. The tines forwardly extend from the base portion of the frame assembly opposite the skid loader such that the tines are designed for engaging materials. A plurality of arm assemblies are coupled to the base portion of the frame assembly. Each of the arm assemblies are articulated such that each of the arm assemblies is positionable with respect to the frame assembly. Each of the arm assemblies are adapted for being operationally coupled to the skid loader such that articulation of each of the arm assemblies is controlled by an operator of the skid loader. The arm assemblies are adapted for facilitating gathering, retaining and removing of materials engaged by said frame assembly.

In these respects, the skid loader attachment according to the present invention substantially departs from the conventional concepts and designs of the prior art, and in so doing provides an apparatus primarily developed for the purpose of increasing the versatility and ease of use of the skid loader.

SUMMARY OF THE INVENTION

In view of the foregoing disadvantages inherent in the known types of buckets for skid loaders now present in the prior art, the present invention provides a new skid loader attachment construction wherein the same can be utilized for increasing the versatility and ease of use of the skid loader.

The general purpose of the present invention, which will be described subsequently in greater detail, is to provide a new skid loader attachment apparatus and method which has many of the advantages of the buckets for skid loaders mentioned heretofore and many novel features that result in a new skid loader attachment which is not anticipated, rendered obvious, suggested, or even implied by any of the prior art buckets for skid loaders, either alone or in any combination thereof.

To attain this, the present invention generally comprises a frame assembly having a base portion. The base portion is designed for coupling to booms of a skid loader. The frame assembly has a plurality of tines. The tines forwardly extend from the base portion of the frame assembly opposite the skid loader such that the tines are designed for engaging materials. A plurality of arm assemblies are coupled to the base portion of the frame assembly. Each of the arm assemblies are articulated such that each of the arm assemblies is positionable with respect to the frame assembly. Each of the arm assemblies are adapted for being operationally coupled to the skid loader such that articulation of each of the arm assemblies is controlled by an operator of the skid loader. The arm assemblies are adapted for facilitating gathering, retaining and removing of materials engaged by said frame assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new skid loader attachment apparatus and method which has many of the advantages of the buckets for skid loaders mentioned heretofore and many novel features that result in a new skid loader attachment which is not anticipated, rendered obvious, suggested, or even implied by any of the prior art buckets for skid loaders, either alone or in any combination thereof.

It is another object of the present invention to provide a new skid loader attachment which may be easily and efficiently manufactured and marketed.

It is a further object of the present invention to provide a new skid loader attachment which is of a durable and reliable construction.

An even further object of the present-invention is to provide a new skid loader attachment which is susceptible of a low cost of manufacture with regard to both materials and labor, and which accordingly is then susceptible of low prices of sale to the consuming public, thereby making such skid loader attachment economically available to the buying public.

Still yet another object of the present invention is to provide a new skid loader attachment which provides in the apparatuses and methods of the prior art some of the advantages thereof, while simultaneously overcoming some of the disadvantages normally associated therewith.

Still another object of the present invention is to provide a new skid loader attachment for increasing the versatility and ease of use of the skid loader.

Yet another object of the present invention is to provide a new skid loader attachment which includes a frame assembly having a base portion. The base portion is designed for coupling to booms of a skid loader. The frame assembly has a plurality of tines. The tines forwardly extend from the base portion of the frame assembly opposite the skid loader such that the tines are designed for engaging materials. A plurality of arm assemblies are coupled to the base portion of the frame assembly. Each of the arm assemblies are articulated such that each of the arm assemblies is positionable with respect to the frame assembly. Each of the arm assemblies are adapted for being operationally coupled to the skid loader such that articulation of each of the arm assemblies is controlled by an operator of the skid loader. The arm assemblies are adapted for facilitating gathering, retaining and removing of materials engaged by said frame assembly.

Still yet another object of the present invention is to provide a new skid loader attachment that increases the safety of the skid loader by permitting the operator to use the arm assemblies to secure materials to the frame assembly from the safety of the safety cage of the skid loader.

Even still another object of the present invention is to provide a new skid loader attachment that is for facilitating collection and removal of materials with respect to the frame assembly through use of the arm assemblies and the varied attachment assemblies.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
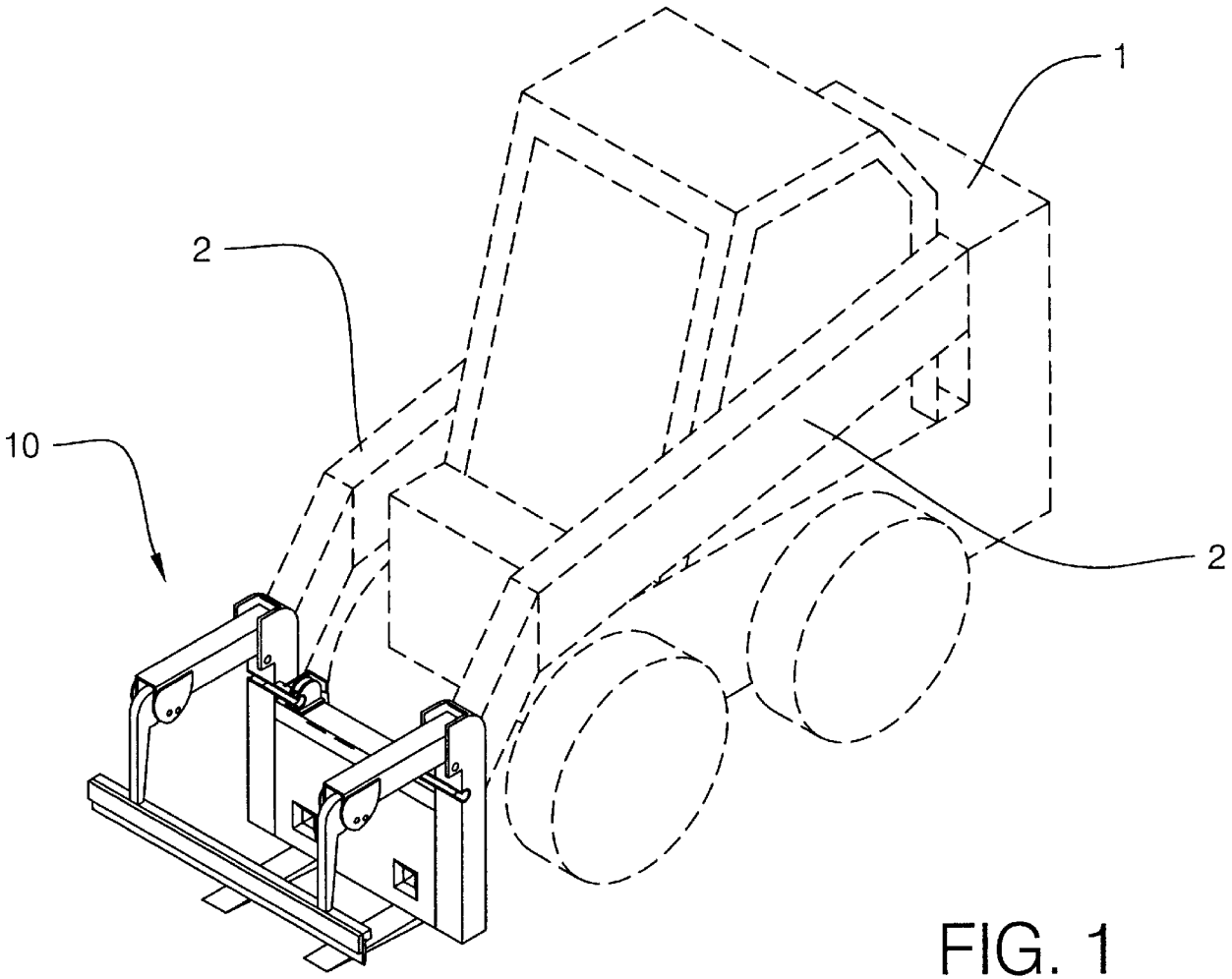
FIG. 1 is a perspective view of a new skid loader attachment according to the present invention.
Figure 2:
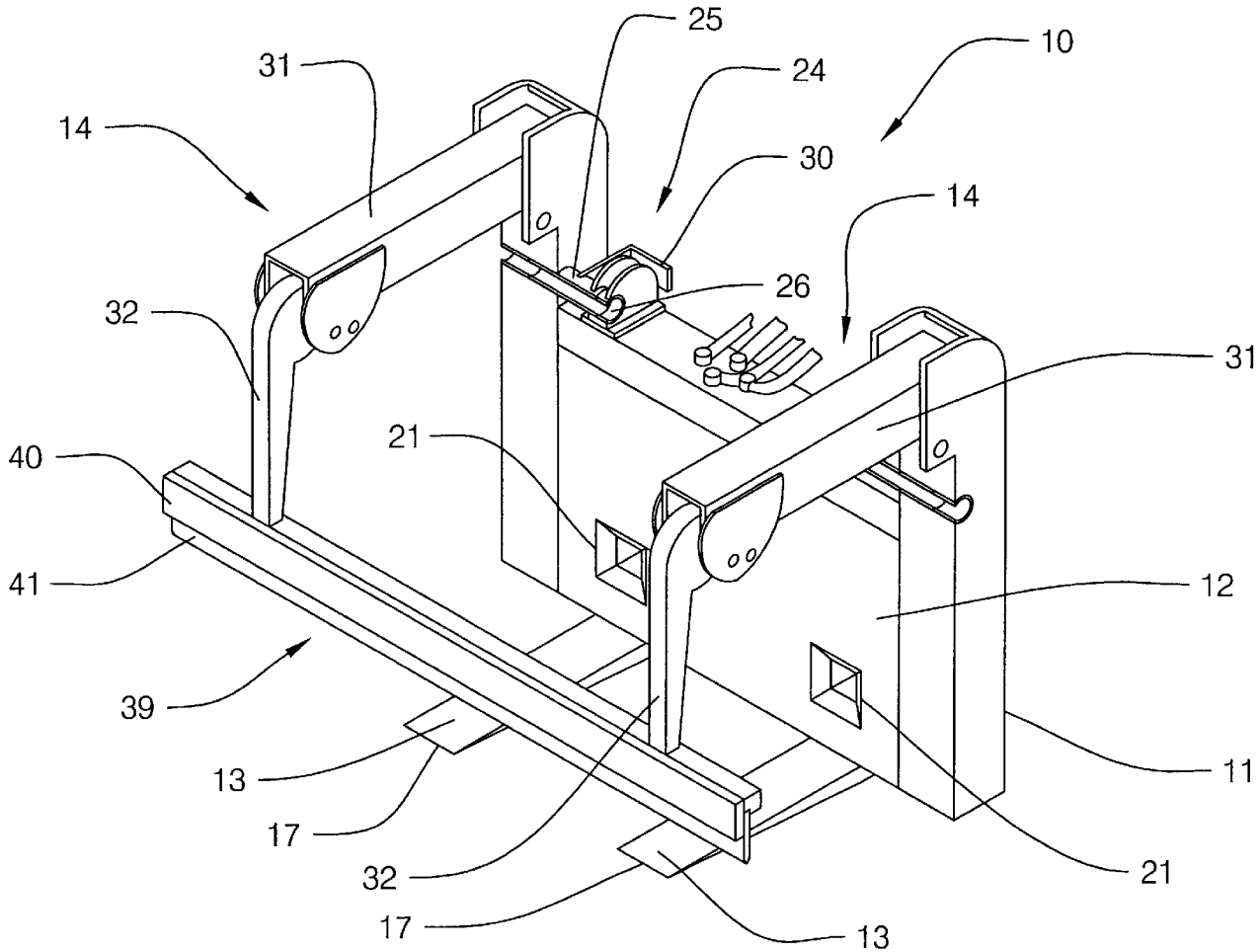
FIG. 2 is an enlarged perspective view of the present invention without the bucket portion.
Figure 3:
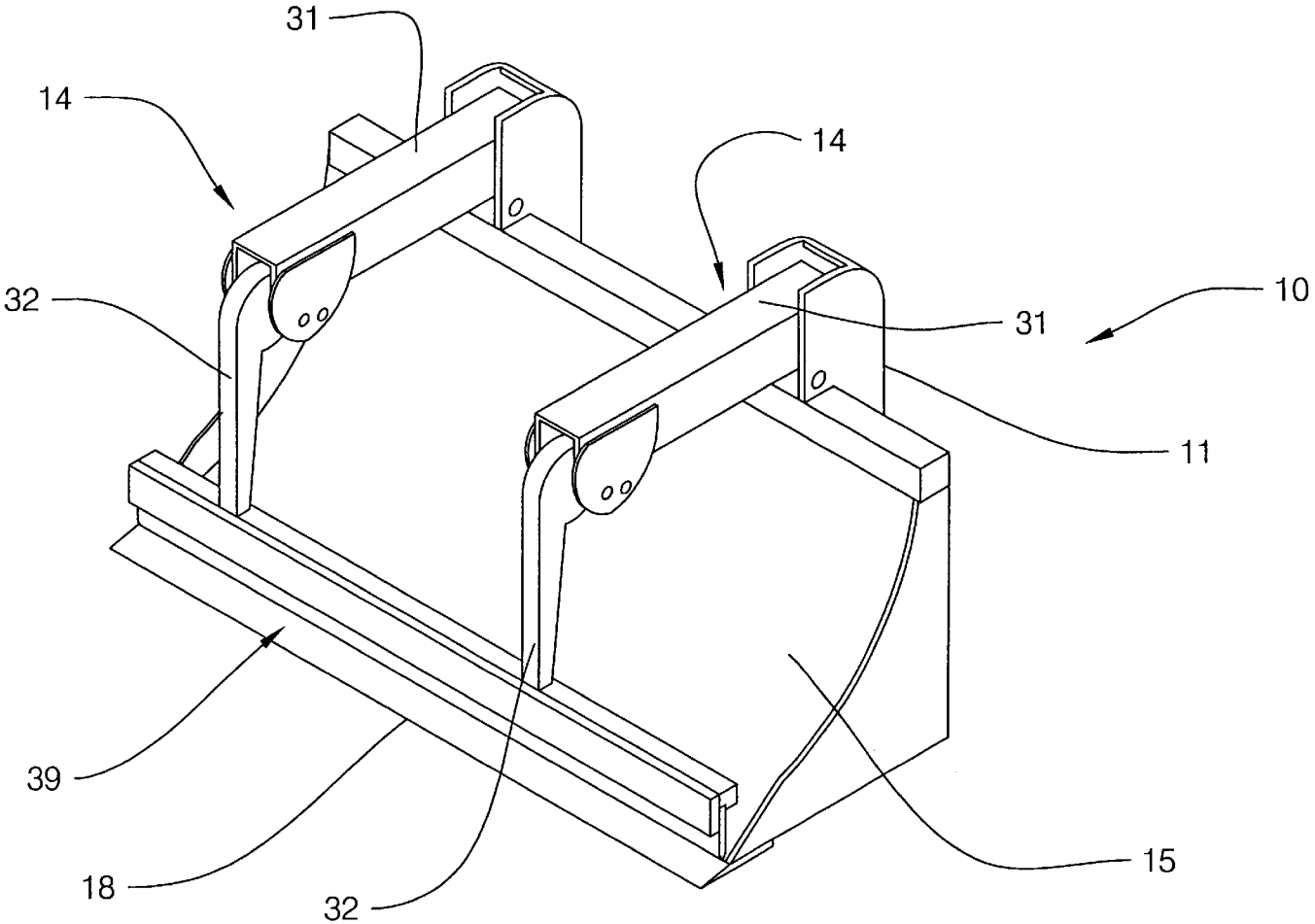
FIG. 3 is an enlarged perspective view of the present invention with the bucket portion.
Figure 4:
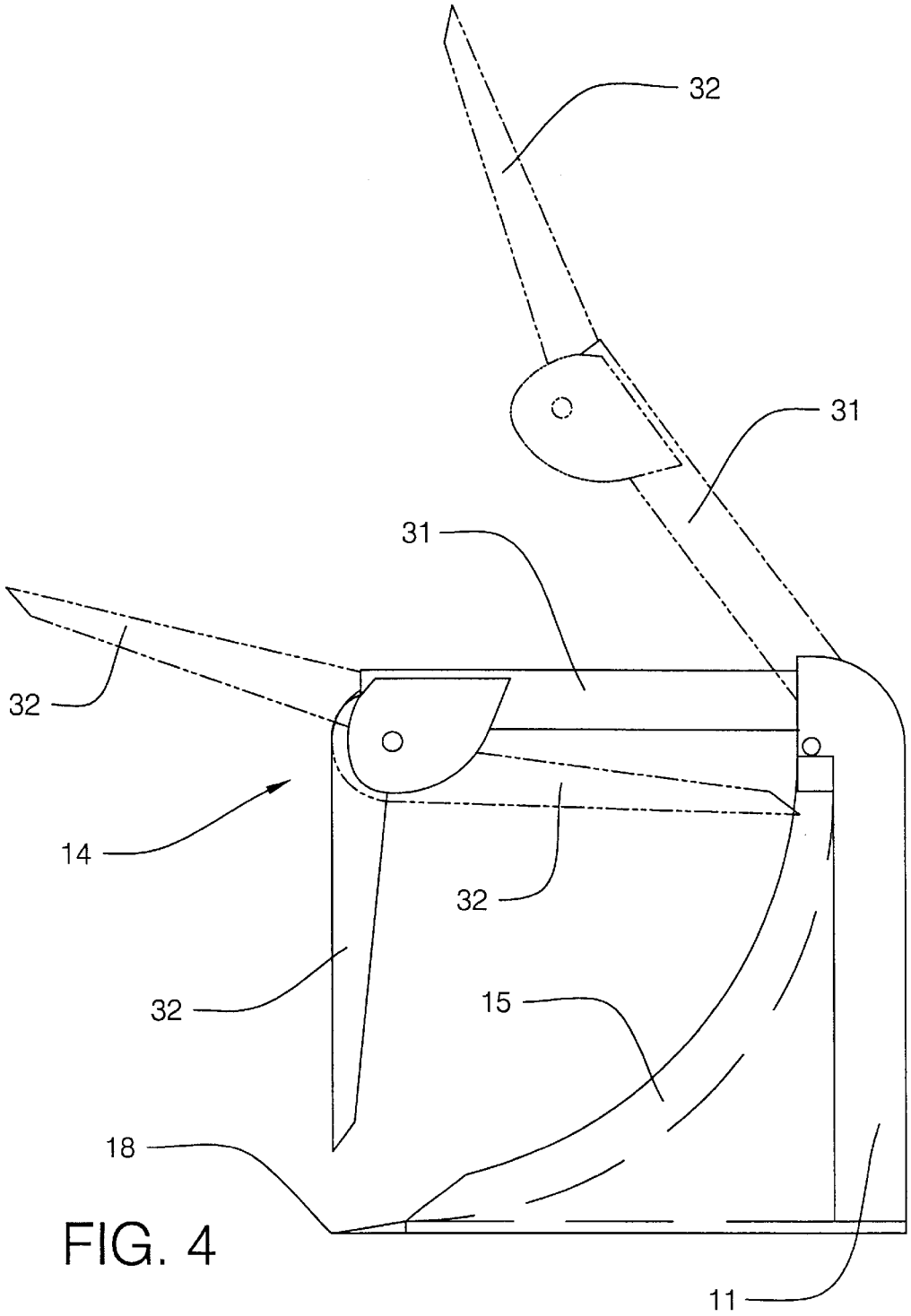
FIG. 4 is a side view of the present invention showing a range of motion of the arm assemblies.
Figure 5:
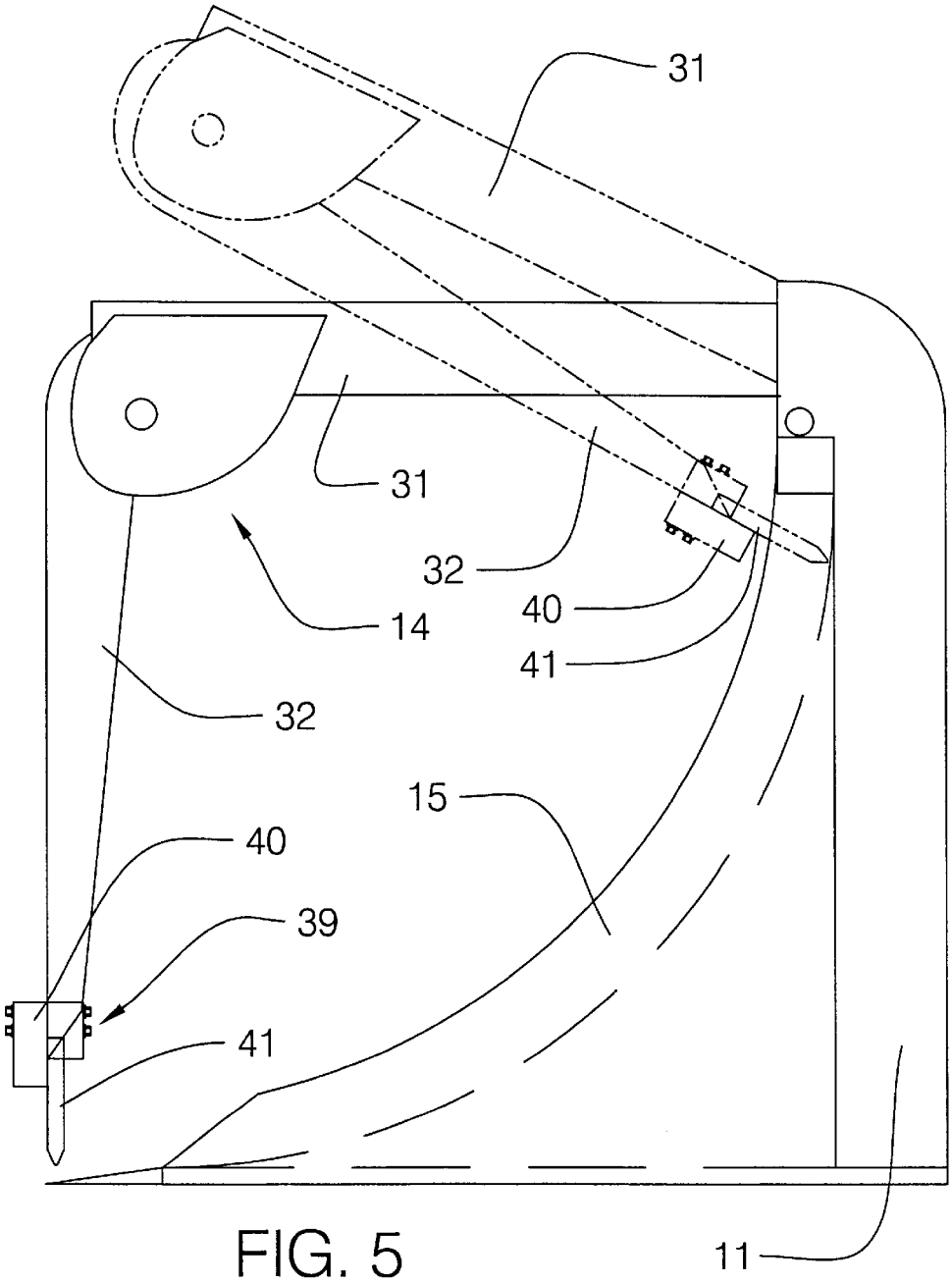
FIG. 5 is a side view of the present invention showing a extents of contact between the attachment assembly and the bucket portion.
Figure 6:
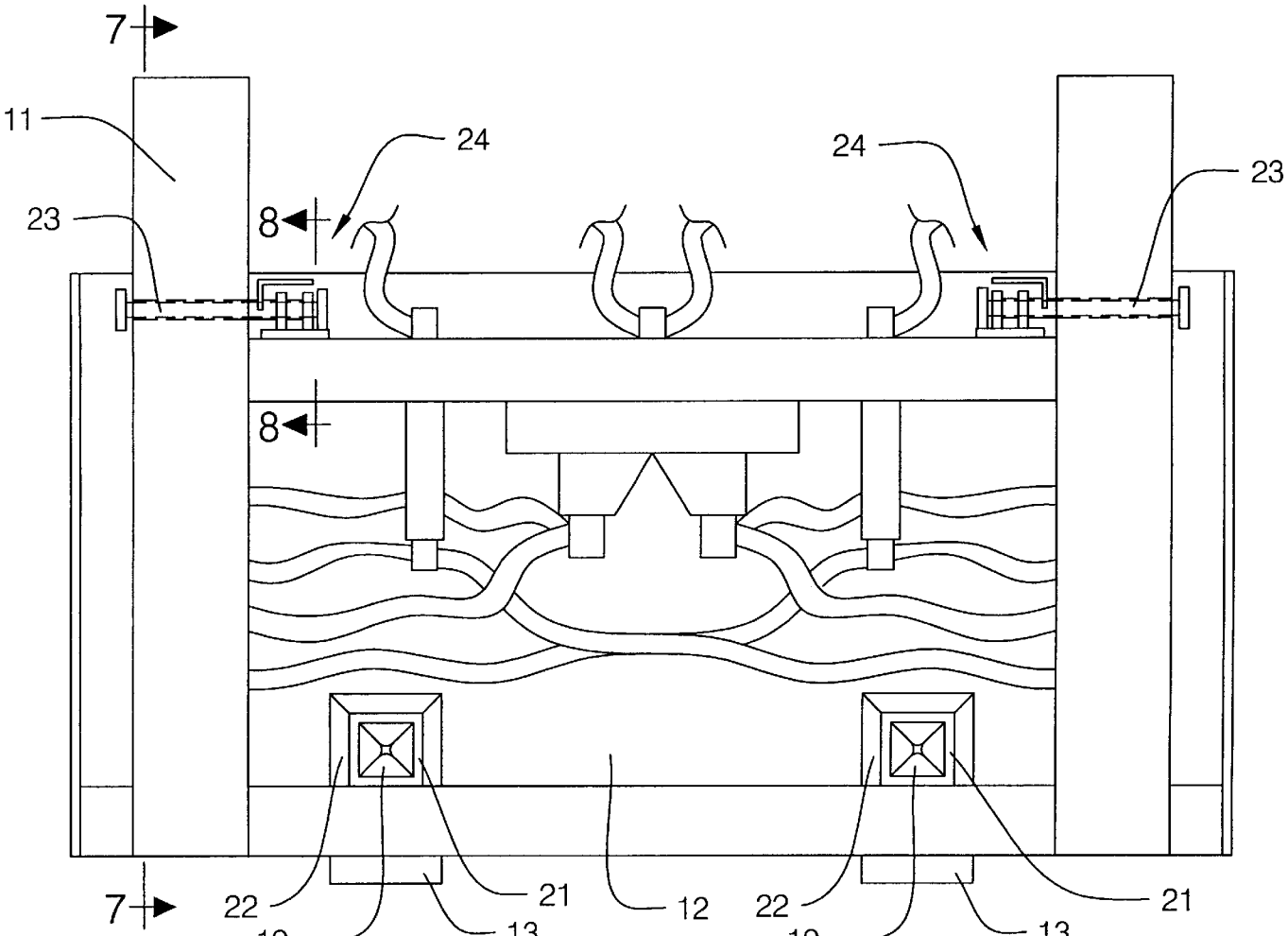
FIG. 6 is a rear view of the present invention.
Figure 7:
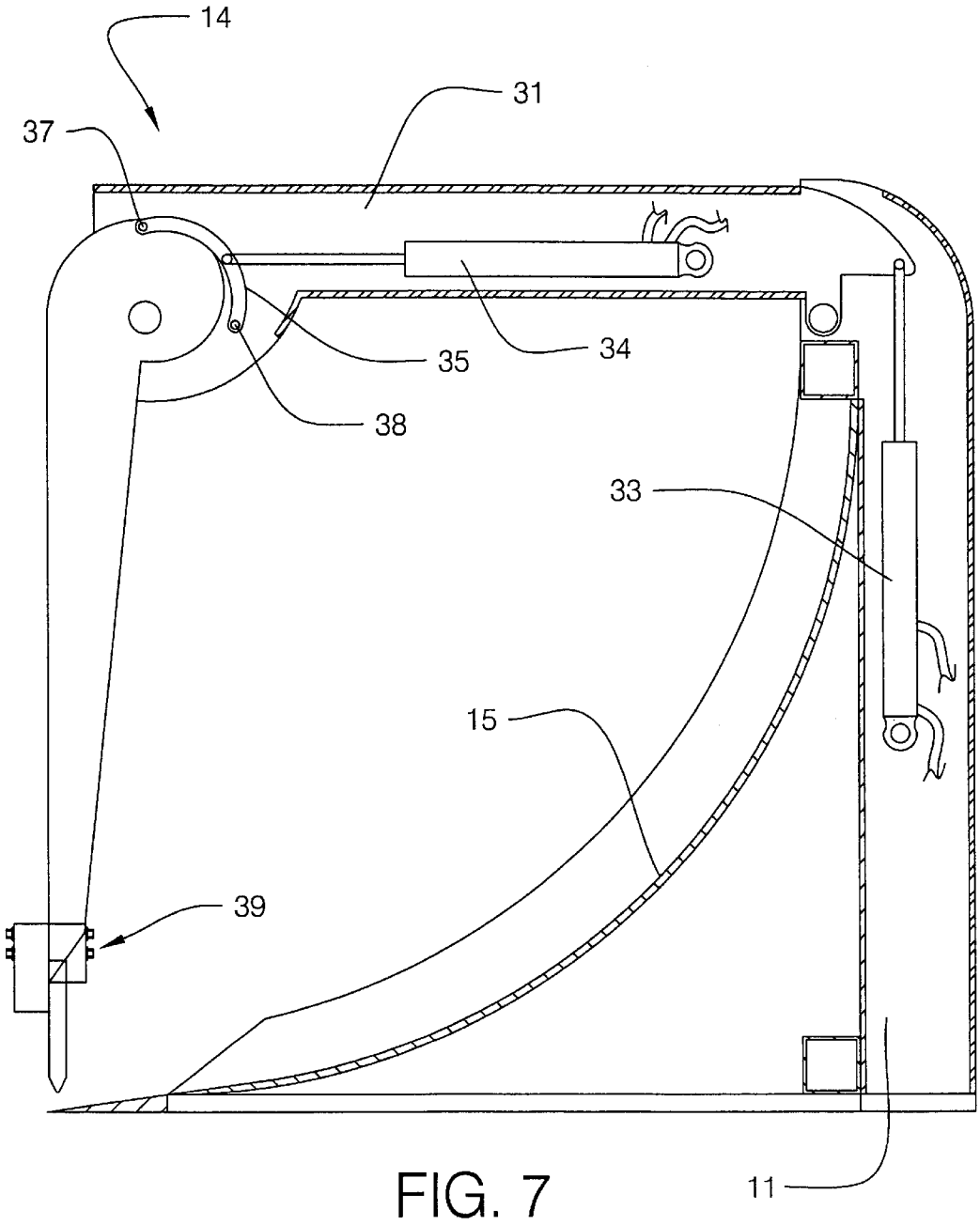
FIG. 7 is a cross-sectional view of the present invention taken along line 7—7 of FIG. 6.
Figure 8:
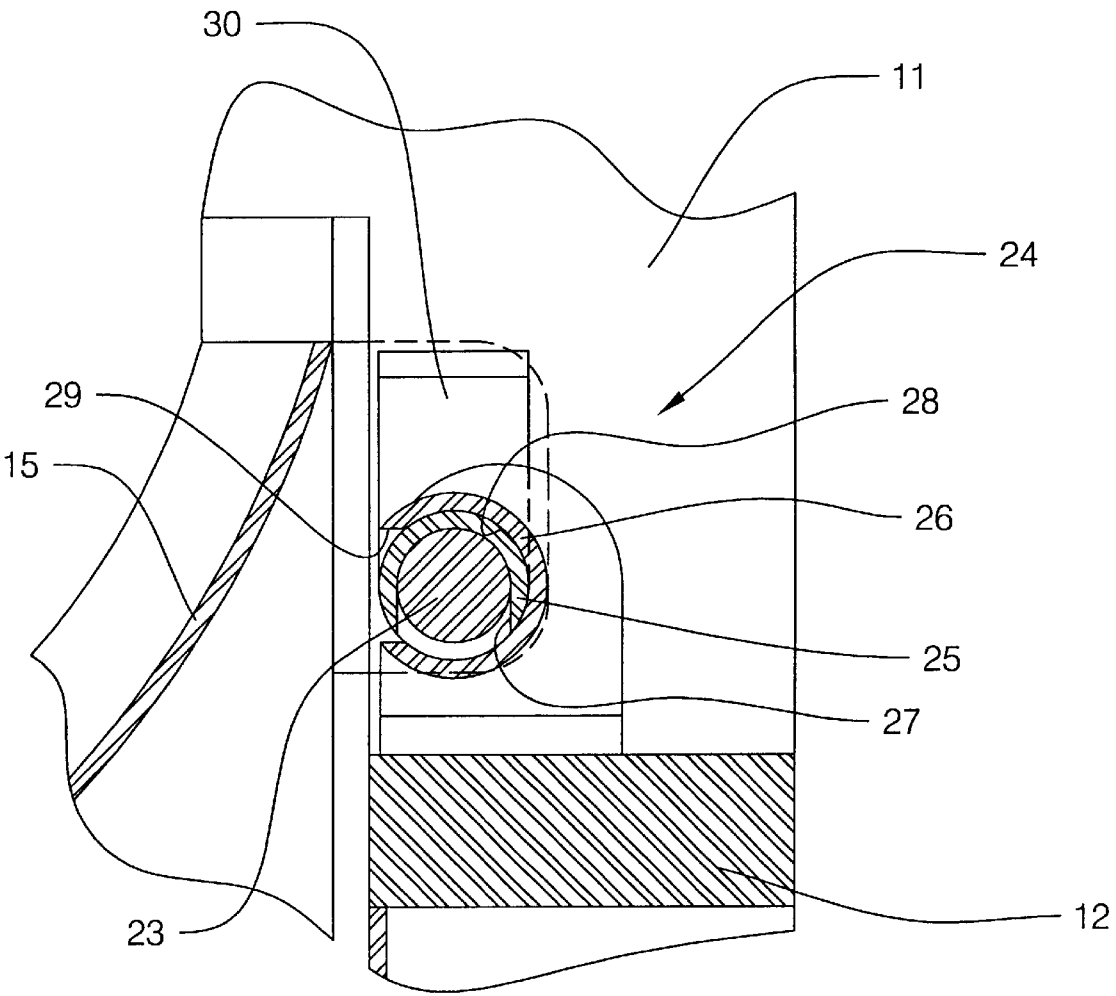
FIG. 8 is a cross-sectional view of the present invention taken along line 8—8 of FIG. 6.
Figure 9:
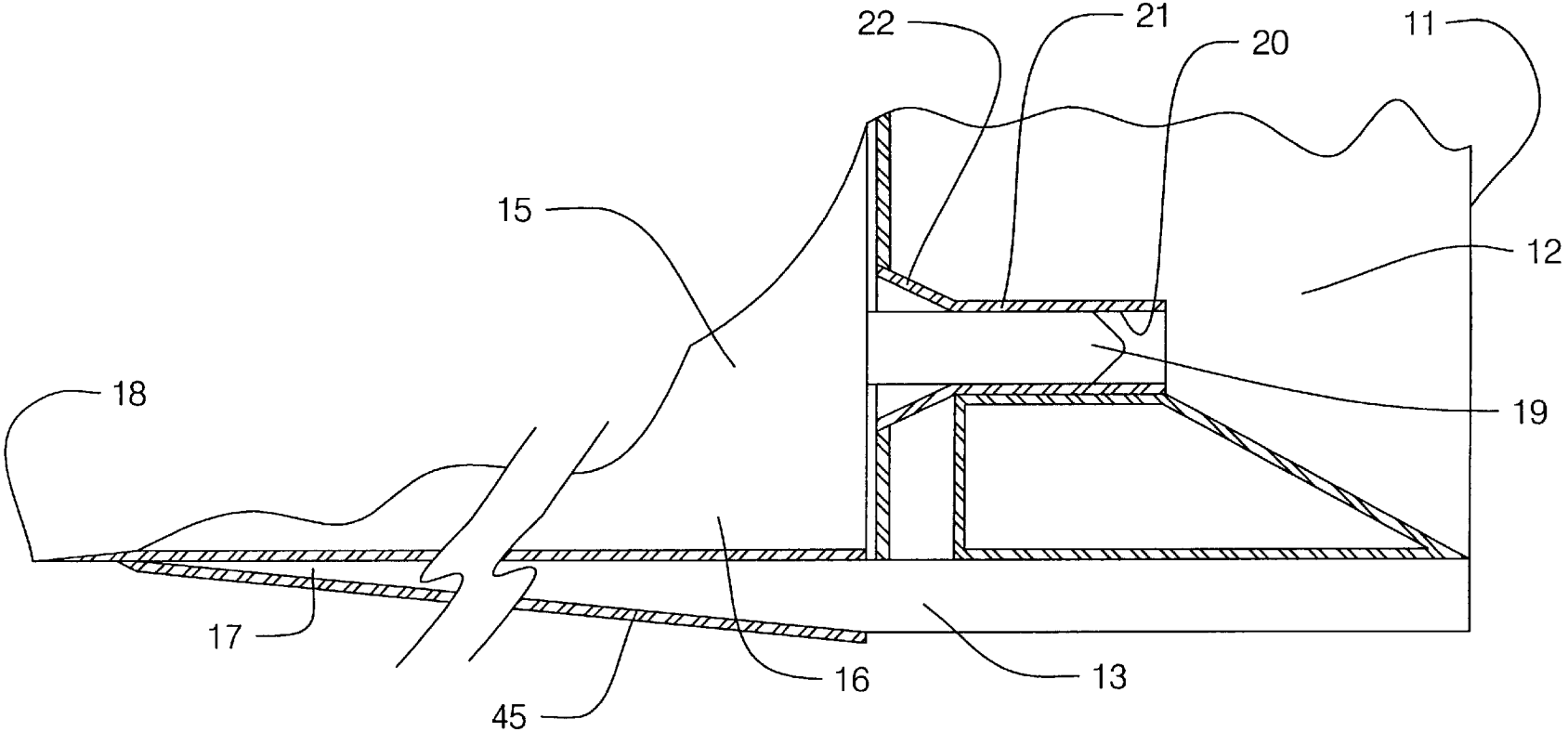
FIG. 9 is a cross-sectional view of the connection between the bucket portion and frame assembly of the present invention.
Figure 10:
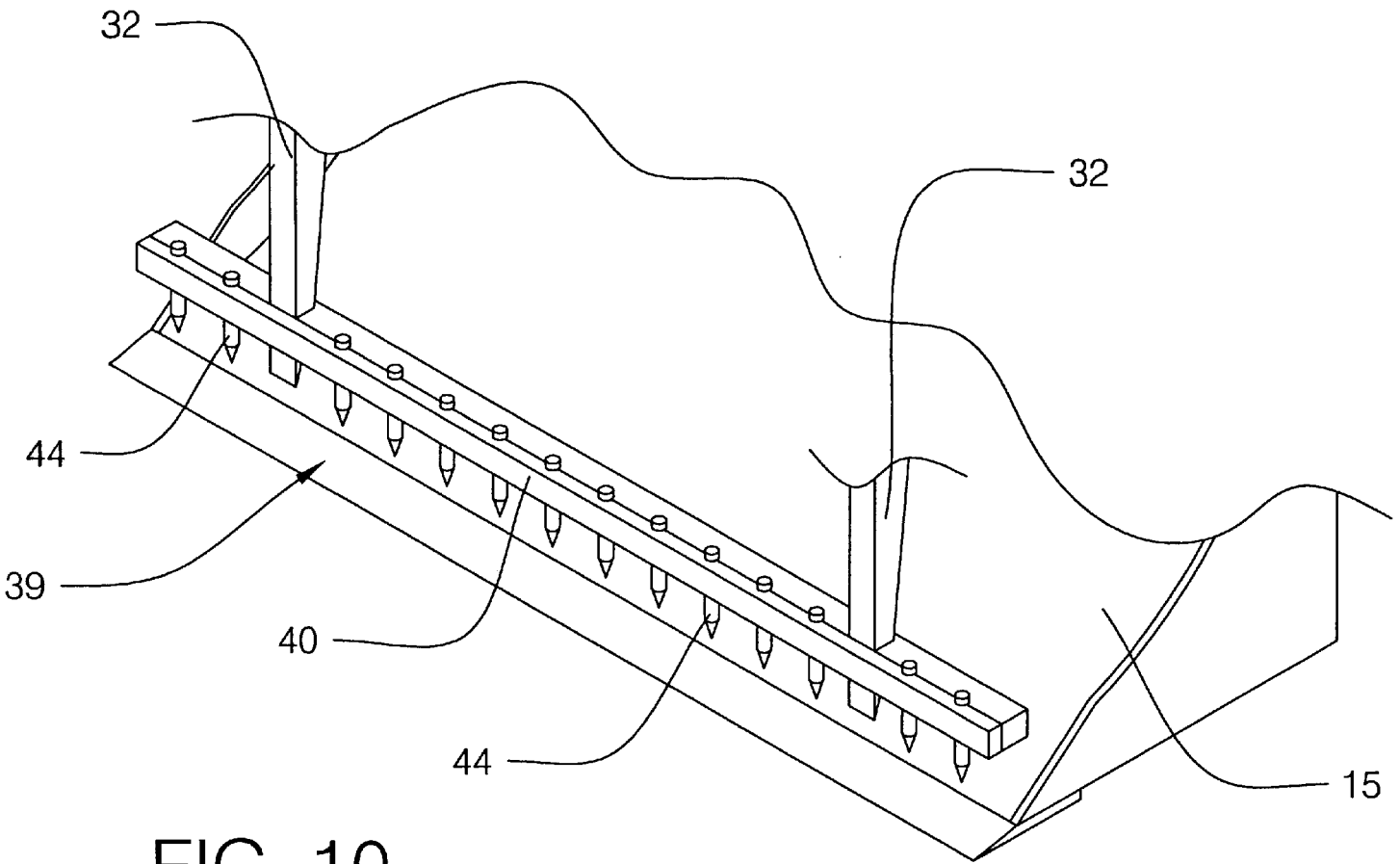
FIG. 10 is a perspective view an embodiment of the attachment assembly of the present invention.
Figure 11:
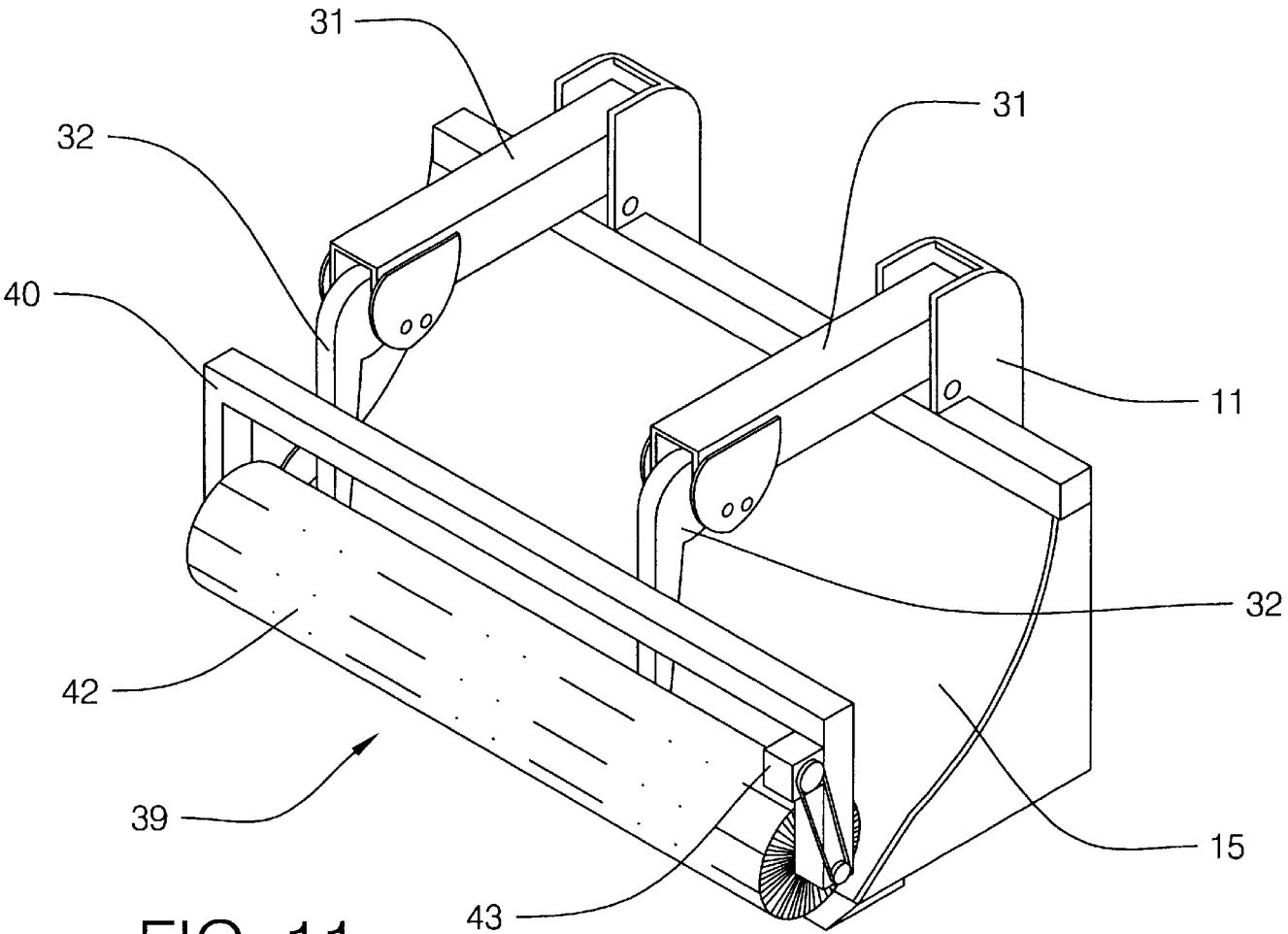
FIG. 11 is a perspective view of an embodiment of the attachment assembly of the present invention.

With reference now to the drawings, and in particular to FIGS. 1 through 6 thereof, a new skid loader attachment embodying the principles and concepts of the present invention and generally designated by the reference numeral 10 will be described.

As best illustrated in FIGS. 1 through 6, the skid loader attachment 10 generally comprises a frame assembly 11 having a base portion 12. The base portion 12 is designed for coupling to the booms 2 of the skid loader 1. The frame assembly 11 has a plurality of tines 13. The tines 13 forwardly extend from the base portion 12 of the frame assembly 11 opposite the skid loader 1 such that the tines 13 are designed for engaging materials. The tines 13 can be used to engage a pallet for lifting and repositioning of the pallet.

A plurality of arm assemblies 14 are coupled to the base portion 12 of the frame assembly 11. Each of the arm assemblies 14 is articulated such that each of the arm assemblies 14 is positionable with respect to the frame assembly 11. Each of the arm assemblies 14 is designed for being operationally coupled to the skid loader 1 such that articulation of each of the arm assemblies 14 is controlled by an operator of the skid loader 1. The arm assemblies 14 are designed for facilitating gathering, retaining and removing of materials engaged by the frame assembly 11. The arm assemblies 14 can be extended over items, for example piping or hay bails, to secure the materials to the frame assembly 11 when the materials are being moved.

A bucket portion 15 is selectively coupled to the base portion 12 of the frame assembly 11. The bucket portion 15 is positioned opposite the skid loader 1 when the bucket portion 15 is coupled to the frame assembly 11. The bucket portion 15 is designed for facilitating the collection of materials unable to be collected by the tines 13 of the frame assembly 11.

The bucket portion 15 has a plurality of tine sleeves 45. Each of the tine sleeves 45 receives one of the tines 13 of the frame assembly 11. Each of the tines 13 is for aiding in supporting the bucket portion 15 when the bucket portion 15 is coupled to the base portion 12 of the frame assembly 11. Each of the tine sleeves 45 is positioned along a bottom 16 of the bucket portion 15. Each of the tine sleeves 45 is for positioning a free end 17 of each of the tines 13 under a leading edge 18 of the bucket portion 15. The free end 17 of each of the tines 13 reinforce the leading edge 18 of the bucket portion 15 when the leading edge 18 is used to scrape materials into the bucket portion 15.

The bucket portion 15 has a plurality of alignment members 19. Each of the alignment members 19 is insertable within a lumen 20 of one of a plurality of alignment sleeves 21 of the frame assembly 11. The alignment members 19 are for facilitating alignment of the bucket portion 15 with the frame assembly 11 when the bucket portion 15 is being coupled to the frame assembly 11. Each of the alignment sleeves 21 of the frame assembly 11 has a flared end 22. The flared end 22 of each of the alignment sleeves 21 is positioned opposite the skid loader 1 such that the flared ends 22 are for guiding each of the alignment members 19 of the bucket portion 15 into the lumen 20 of an associated one of the alignment sleeves 21.

The bucket portion 15 has a plurality of locking bars 23. Each of the locking bars 23 is received by one of a plurality of locking assemblies 24 of the frame assembly 11. Each of the locking assemblies 24 is for securing the bucket portion 15 to the frame assembly 11 when each the locking assemblies 24 receives one of the locking bars 23 of the bucket portion 15. Each of the locking assemblies 24 of the frame assembly 11 has an interior sleeve 25 and an exterior sleeve 26. The interior sleeve 25 is positioned within the exterior sleeve 26 such that the interior sleeve 25 is rotatable with respect to the exterior sleeve 26. The interior sleeve 25 has an opening 27 through the interior sleeve 25 for permitting access to a lumen 28 of the interior sleeve 25. The opening 27 of the interior sleeve 25 is alignable with a gap 29 of the exterior sleeve 26 such that one of the locking bars 23 of the bucket portion 15 is insertable through the gap 29 of the exterior sleeve 26 and the opening 27 of the interior sleeve 25 into the lumen 28 of the interior sleeve 25. The interior sleeve 25 is rotated with respect to the exterior sleeve 26 for misaligning the opening 27 of the interior sleeve 25 and the gap 29 of the exterior sleeve 26 for securing one of the locking bars 23 of the bucket portion 15 within the lumen 28 of the interior sleeve 25. Each of the locking assemblies 24 of the frame assembly 11 has a handle 30. The handle 30 of each of the locking assemblies 24 is coupled to the interior sleeve 25 of an associated one of the locking assemblies 24 of the frame assembly 11. The handle 30 facilitates rotation of the interior sleeve 25 with respect to the exterior sleeve 26 of the associated one of the locking assemblies 24 of the frame assembly 11.

Each of the arm assemblies 14 has a first arm member 31 and a second arm member 32. The first arm member 31 is pivotally coupled to the frame assembly 11. The second arm member 32 is pivotally coupled to the first arm member 31 opposite the frame assembly 11. The first arm member 31 and the second arm member 32 are positionable with respect to the frame assembly 11 for facilitating collecting, retaining and removing the materials with respect to the frame assembly 11.

Each of the arm assemblies 14 has a frame ram 33. The frame ram 33 is coupled between the first arm member 31 and the frame assembly 11. The frame ram 33 is designed for hydraulically coupling to the skid loader 1 such that the frame ram 33 is for controlling pivoting of the first arm member 31 with respect to the frame assembly 11. Each of the arm assemblies 14 has an arm ram 34. The arm ram 34 of each of the arm assemblies 14 is coupled between the second arm member 32 and the first arm member 31 of an associated one of the arm assemblies 14. The arm ram 34 is designed for hydraulically coupling to the skid loader 1 such that the arm ram 34 is for controlling pivoting of the second arm member 32 with respect first arm member 31. The hydraulics for the frame ram 33 and the arm ram 34 of each of the arm assemblies 14 are contained within the frame assembly 11 for inhibiting failure of the arm assemblies 14 due to pinching and binding of the hydraulic lines when in use.

Each of the arm assemblies 14 has a leverage member 35. The leverage member 35 is pivotally coupled between the second arm member 32 and the first arm member 31. The arm ram 34 is coupled to the leverage member 35 such that such that the leverage member 35 increases mechanical advantage of the arm ram 34 when the arm ram 34 is pivoting the second arm member 32 with respect to the first arm member 31.

The leverage member 35 of each of the arm assemblies 14 has a body portion 36. The body portion 36 arcuately extends between a first mounting end 37 and a second mounting end 38. The first mounting end 37 is pivotally coupled to the second arm member 32. The second mounting end 38 of the leverage member 35 is coupled to the first arm member 31. The arm ram 34 is coupled to the body portion 36 of the leverage member 35 such that the leverage member 35 increases pivotal movement of the second arm member 32 from lateral movement of the arm ram 34.

Figure 12:
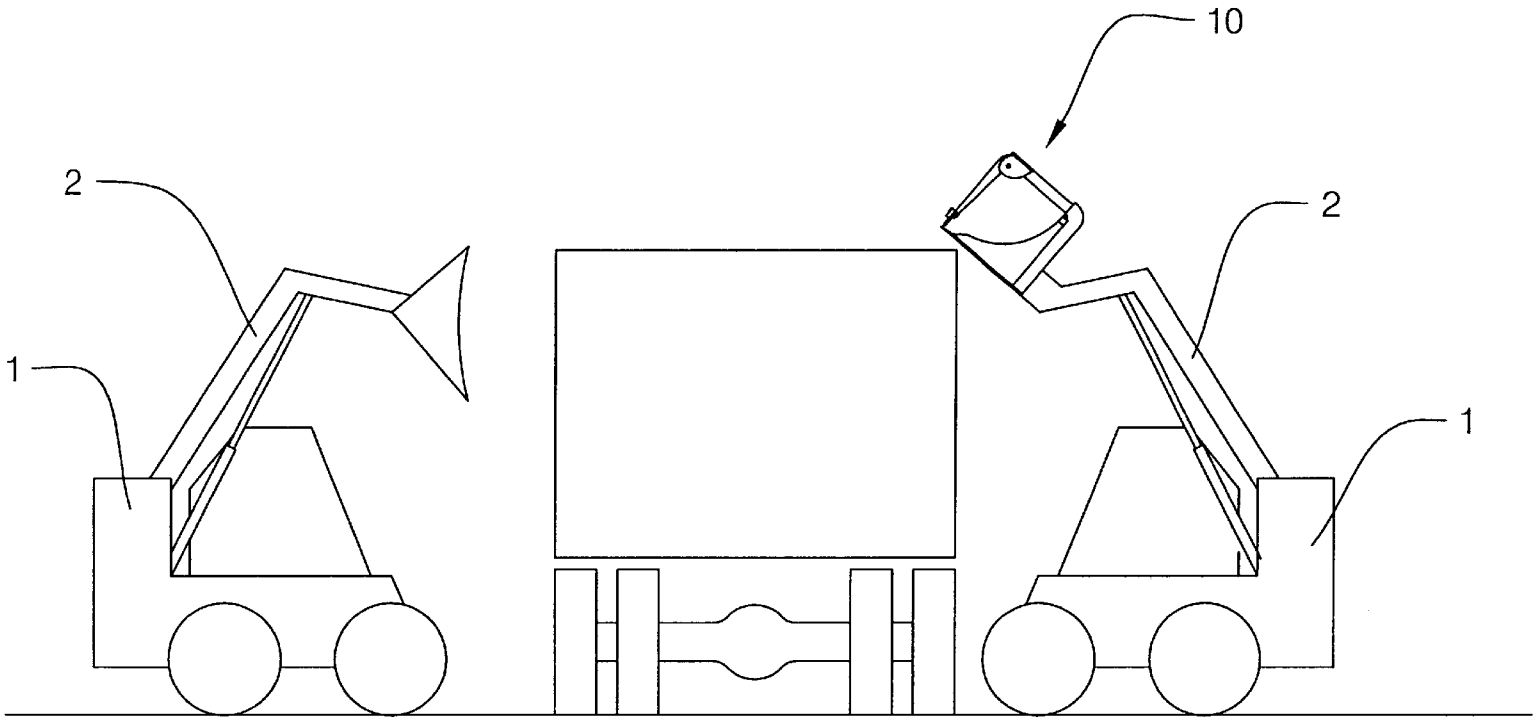
FIG. 12 is a side view of a range of reach comparison of the present invention with a standard skid loader.

An attachment assembly 39 is selectively coupled to the arm assemblies 14. The attachment assembly 39 has a base member 40 coupled to the arm assemblies 14. The attachment assembly 39 is designed for facilitating collection and depositing of materials In an embodiment the attachment assembly 39 has a blade portion 41. The blade portion 41 is coupled to the base member 40 such that the blade portion 41 extends towards the frame assembly 11. The blade portion 41 is designed for facilitating accumulation and discharging of material with respect to the frame assembly 11. The arm assemblies 14 can be positioned such that the blade portion 41 can make of full sweep of the bucket portion 15 thereby permitting the operator to completely empty the bucket portion 15 of materials such as concrete when filling forms. This also allows the user to completely discharge materials from the bucket portion without the need to tip the bucket portion and thereby permitting the skid loader 1 to dump into larger vehicles, as illustrated in FIG. 12. The blade portion 41 of the attachment assembly 39 comprises a flexible material. The flexible material of the blade portion 41 permitting scraping of the material from bucket portion 15 and the frame assembly 11.

In another embodiment, the attachment assembly 39 has a brush member 42. The brush member 42 is rotatably coupled to the base member 40 of the attachment assembly 39. A motor assembly 43 is operationally coupled to the brush member 42 such that the motor assembly 43 rotates the brush member 42 with respect to the base member 40 of the attachment assembly 39. The brush member 42 is designed for brushing material into and out of the frame assembly 11. The motor assembly 43 is hydraulically coupled to the skid loader 1 such that the motor assembly 43 is operated by the hydraulics of the skid loader 1.

In another embodiment, the attachment assembly 39 has a plurality of fingers 44. Each of the fingers 44 is flexibly coupled to the base member 40 of the attachment assembly 39. Each of the fingers 44 is designed for facilitating collection and removal of the material with respect to the frame assembly 11. The plurality of fingers 44 are for pushing items such as rocks into the bucket portion 15 while flexing to prevent heavier item to pass through the fingers 44 without damaging the fingers 44.

In an embodiment, the applicant's skid steer loader rotatable attachment, U.S. Pat. No. 5,562,398, can be used in conjunction with the features described to provide further versatility for collection and unloading materials when using the skid loader attachment.

In use, the frame assembly is coupled to the booms of the skid loader and the arm assemblies are hydraulically coupled to the skid loader. The operator of the skid loader is then capable of controlling the arm assemblies to collect items and secure items to the frame assembly without the need for the operator to leave the safety of the cab. The tines of the frame assembly can be used to collect and reposition pallets. The bucket portion may be coupled to the frame assembly to permit the operator to use the bucket portion for scooping up materials and for carrying the scooped up materials. The attachment assembly can be coupled to the arm assemblies to permit the operator to collect materials and remove materials that may be to difficult to scoop into the bucket portion. Further, the blade portion of the attachment assembly can be used to selectively remove a portion of the material in the bucket portion such as selectively measuring out a quantity of cement from the bucket portion. Further, the attachment assembly, through positioning of the arm assemblies, can be drawn along the entire width of the bucket portion to completely remove materials from the bucket portion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A skid loader attachment for facilitating collection and depositing materials with a skid loader, the skid loader attachment comprising:

a frame assembly having a base portion, said base portion being adapted for coupling to booms of the skid loader, said frame assembly having a plurality of tines, said tines forwardly extending from said base portion of said frame assembly opposite the skid loader such that said tines are adapted for engaging materials;

a plurality of arm assemblies being coupled to said base portion of said frame assembly, each of said arm assemblies being articulated such that each of said arm assemblies is positionable with respect to said frame assembly, each of said arm assemblies being adapted for being operationally coupled to the skid loader such that articulation of each of said arm assemblies is controlled by an operator of the skid loader, said arm assemblies being adapted for facilitating gathering, retaining and removing of materials engaged by said frame assembly;

each of said arm assemblies having a first arm member and a second arm member, said first arm member being pivotally coupled to said frame assembly, said second arm member being pivotally coupled to said first arm member opposite said frame assembly, said first arm member and said second arm member being positionable with respect to said frame assembly for facilitating collecting, retaining and removing the materials with respect to said frame assembly;

each of said arm assemblies having an arm ram, said arm ram of each of said arm assemblies being coupled between said second arm member and said first arm member of an associated one of said arm assemblies, said arm ram being adapted for hydraulically coupling to the skid loader such that said arm ram is for controlling pivoting of said second arm member with respect first arm member;

each of said arm assemblies having a leverage member, said leverage member being pivotally coupled between said second arm member and said first arm member, said arm ram being coupled to said leverage member such that such that said leverage member increases mechanical advantage of said arm ram when said arm ram is pivoting said second arm member with respect to said first arm member; and said leverage member of each of said arm assemblies having a body portion, said body portion arcuately extending between a first mounting end and a second mounting end, said first mounting end being pivotally coupled to said second arm member, said second mounting end of said leverage member being coupled to said first arm member, said arm ram being coupled to said body portion of said leverage member such that said leverage member increases pivotal movement of said second arm member from lateral movement of said arm.

2. The skid loader attachment as set forth in claim 1, further comprising:

a bucket portion being selectively coupled to said base portion of said frame assembly such that said bucket portion is positioned opposite the skid loader, said bucket portion being adapted for facilitating collecting of materials unable to be collected by said tines of said frame assembly.

3. The skid loader attachment as set forth in claim 2, further comprising:

said bucket portion having a plurality of tine sleeves, each of said tine sleeves receiving one of said tines of said frame assembly, each of said tines being for aiding in supporting said bucket portion when said bucket portion is coupled to said base portion of said frame assembly.

4. The skid loader attachment as set forth in claim 3, further comprising:

each of said tine sleeves being positioned along a bottom of said bucket portion, each of said tine sleeves being for positioning a free end of each of said tines under a leading edge of said bucket portion such that said free ends of said tines are for reinforcing said leading edge of said bucket portion when said leading edge is used to scrape materials into said bucket portion.

5. The skid loader attachment as set forth in claim 2, further comprising:

said bucket portion having a plurality of alignment members, each of said alignment members being insertable within a lumen of one of a plurality of alignment sleeves of said frame assembly such that said alignment members are for facilitating alignment of said bucket portion with said frame assembly when said bucket portion is being coupled to said frame assembly.

6. The skid loader attachment as set forth in claim 5, further comprising:

each of said alignment sleeves of said frame assembly having a flared end, said flared end of each of said alignment sleeves being positioned opposite the skid loader such that said flared ends are for funneling each of said alignment members of said bucket portion into said lumen of an associated one of said alignment sleeves.

7. The skid loader attachment as set forth in claim 2, further comprising:

said bucket portion having a plurality of locking bars, each of said locking bars being received by one of a plurality of locking assemblies of said frame assembly, each of said locking assemblies being for securing said bucket portion to said frame assembly when each said locking assemblies receives one of said locking bars of said bucket portion.

8. The skid loader attachment as set forth in claim 7, further comprising:

each of said locking assemblies of said frame assembly having an interior sleeve and an exterior sleeve, said interior sleeve being positioned within said exterior sleeve such that said interior sleeve is rotatable with respect to said exterior sleeve, said interior sleeve having an opening through said interior sleeve for permitting access to a lumen of said interior sleeve, said opening of said interior sleeve being alignable with a gap of said exterior sleeve such that one of said locking bars of said bucket portion is insertable through said gap of said exterior sleeve and said opening of said interior sleeve into said lumen of said interior sleeve, said interior sleeve being rotated with respect to said exterior sleeve for misaligning said opening of said interior sleeve and said gap of said exterior sleeve for securing one of said locking bars of said bucket portion within said lumen of said interior sleeve.

9. The skid loader attachment as set forth in claim 8, further comprising:

each of said locking assemblies of said frame assembly having a handle, said handle of each of said locking assemblies being coupled to said interior sleeve of an associated one of said locking assemblies of said frame assembly, said handle facilitating rotation of said interior sleeve with respect to said exterior sleeve of the associated one of said locking assemblies of said frame assembly.

10. The skid loader attachment as set forth in claim 1, further comprising:

each of said arm assemblies having a frame ram, said frame ram being coupled between said first arm member and said frame assembly, said frame ram being adapted for hydraulically coupling to the skid loader such that said frame ram is for controlling pivoting of said first arm member with respect to said frame assembly.

11. The skid loader attachment as set forth in claim 1, further comprising:

an attachment assembly being selectively coupled to said arm assemblies, said attachment assembly having a base member being coupled to said arm assemblies, said attachment assembly being adapted for facilitating collection and depositing of materials.

12. The skid loader attachment as set forth in claim 11, further comprising:

said attachment assembly having a blade portion, said blade portion being coupled to said base member such that said blade portion extends towards said frame assembly, said blade assembly being adapted for facilitating accumulation and discharging of material with respect to said frame assembly.

13. The skid loader attachment as set forth in claim 12, further comprising:

said blade portion of said attachment assembly comprising a flexible material, said flexible material of said blade portion permitting scraping of said material from said frame assembly.

14. The skid loader attachment as set forth in claim 11, further comprising:

said attachment assembly having a brush member, said brush member being rotatably coupled to said base member of said attachment assembly, a motor assembly being operationally coupled to said brush member such that said motor assembly rotates said brush member with respect to said base member of said attachment assembly, said brush member being adapted for brushing material into and out of said frame assembly.

15. The skid loader attachmnent as set forth in claim 11, further comprising:

said attachment assembly having a plurality of fingers, each of said fingers being coupled to said base member of said attachment assembly, each of said fingers being adapted for facilitating collection and removal of the material with respect to said frame assembly.

16. A skid loader attachment for facilitating collection and depositing materials with a skid loader, the skid loader attachment comprising:

a frame assembly having a base portion, said base portion being adapted for coupling to booms of the skid loader, said frame assembly having a plurality of tines, said tines forwardly extending from said base portion of said frame assembly opposite the skid loader such that said tines are adapted for engaging materials;

a plurality of arm assemblies being coupled to said base portion of said frame assembly, each of said arm assemblies being articulated such that each of said arm assemblies is positionable with respect to said frame assembly, each of said arm assemblies being adapted for being operationally coupled to the skid loader such that articulation of each of said arm assemblies is controlled by an operator of the skid loader, said arm assemblies being adapted for facilitating gathering, retaining and removing of materials engaged by said frame assembly;

a bucket portion being selectively coupled to said base portion of said frame assembly such that said bucket portion is positioned opposite the skid loader, said bucket portion being adapted for facilitating collecting of materials unable to be collected by said tines of said frame assembly;

said bucket portion having a plurality of tine sleeves, each of said tine sleeves receiving one of said tines of said frame assembly, each of said tines being for aiding in supporting said bucket portion when said bucket portion is coupled to said base portion of said frame assembly;

each of said tine sleeves being positioned along a bottom of said bucket portion, each of said tine sleeves being for positioning a free end of each of said tines under a leading edge of said bucket portion such that said free ends of said tines are for reinforcing said leading edge of said bucket portion when said leading edge is used to scrape materials into said bucket portion;

said bucket portion having a plurality of alignment members, each of said alignment members being insertable within a lumen of one of a plurality of alignment sleeves of said frame assembly such that said alignment members are for facilitating alignment of said bucket portion with said frame assembly when said bucket portion is being coupled to said frame assembly;

each of said alignment sleeves of said frame assembly having a flared end, said flared end of each of said alignment sleeves being positioned opposite the skid loader such that said flared ends are for funneling each of said alignment members of said bucket portion into said lumen of an associated one of said alignment sleeves;

said bucket portion having a plurality of locking bars, each of said locking bars being received by one of a plurality of locking assemblies of said frame assembly, each of said locking assemblies being for securing said bucket portion to said frame assembly when each said locking assemblies receives one of said locking bars of said bucket portion;

each of said locking assemblies of said frame assembly having an interior sleeve and an exterior sleeve, said interior sleeve being positioned within said exterior sleeve such that said interior sleeve is rotatable with respect to said exterior sleeve, said interior sleeve having an opening through said interior sleeve for permitting access to a lumen of said interior sleeve, said opening of said interior sleeve being alignable with a gap of said exterior sleeve such that one of said locking bars of said bucket portion is insertable through said gap of said exterior sleeve and said opening of said interior sleeve into said lumen of said interior sleeve, said interior sleeve being rotated with respect to said exterior sleeve for misaligning said opening of said interior sleeve and said gap of said exterior sleeve for securing one of said locking bars of said bucket portion within said lumen of said interior sleeve;

each of said locking assemblies of said frame assembly having a handle, said handle of each of said locking assemblies being coupled to said interior sleeve of an associated one of said locking assemblies of said frame assembly, said handle facilitating rotation of said interior sleeve with respect to said exterior sleeve of the associated one of said locking assemblies of said frame assembly;

each of said arm assemblies having a first arm member and a second arm member, said first arm member being pivotally coupled to said frame assembly, said second arm member being pivotally coupled to said first arm member opposite said frame assembly, said first arm member and said second arm member being positionable with respect to said frame assembly for facilitating collecting, retaining and removing the materials with respect to said frame assembly;

each of said arm assemblies having a frame ram, said frame ram being coupled between said first arm member and said frame assembly, said frame ram being adapted for hydraulically coupling to the skid loader such that said frame ram is for controlling pivoting of said first arm member with respect to said frame assembly;

each of said arm assemblies having an arm ram, said arm ram of each of said arm assemblies being coupled between said second arm member and said first arm member of an associated one of said arm assemblies, said arm ram being adapted for hydraulically coupling to the skid loader such that said arm ram is for controlling pivoting of said second arm member with respect first arm member;

each of said arm assemblies having a leverage member, said leverage member being pivotally coupled between said second arm member and said first arm member, said arm ram being coupled to said leverage member such that such that said leverage member increases mechanical advantage of said arm ram when said arm ram is pivoting said second arm member with respect to said first arm member; and said leverage member of each of said arm assemblies having a body portion, said body portion arcuately extending between a first mounting end and a second mounting end, said first mounting end being pivotally coupled to said second arm member, said second mounting end of said leverage member being coupled to said first arm member, said arm ram being coupled to said body portion of said leverage member such that said leverage member increases pivotal movement of said second arm member from lateral movement of said arm ram.

17. The skid loader attachment as set forth in claim 16, further comprising:

an attachment assembly being selectively coupled to said arm assemblies, said attachment assembly having a base member being coupled to said arm assemblies, said attachment assembly being adapted for facilitating collection and depositing of materials.

18. The skid loader attachment as set forth in claim 17, further comprising:

said attachment assembly having a blade portion, said blade portion being coupled to said base member such that said blade portion extends towards said frame assembly, said blade assembly being adapted for facilitating accumulation and discharging of material with respect to said frame assembly.

19. The skid loader attachment as set forth in claim 18, further comprising:

said blade portion of said attachment assembly comprising a flexible material, said flexible material of said blade portion permitting scraping of said material from said frame assembly.

20. The skid loader attachment as set forth in claim 17, further comprising:

said attachment assembly having a brush member, said brush member being rotatably coupled to said base member of said attachment assembly, a motor assembly being operationally coupled to said brush member such that said motor assembly rotates said brush member with respect to said base member of said attachment assembly, said brush member being adapted for brushing material into and out of said frame assembly.

21. The skid loader attachment as set forth in claim 17, further comprising:

said attachment assembly having a plurality of fingers, each of said fingers being coupled to said base member of said attachment assembly, each of said fingers being adapted for facilitating collection and removal of the material with respect to said frame assembly.

22. A skid loader attachment for facilitating collection and depositing materials with a skid loader, the skid loader attachment comprising:

a frame assembly having a base portion, said base portion being adapted for coupling to booms of the skid loader, said frame assembly having a plurality of tines, said tines forwardly extending from said base portion of said frame assembly opposite the skid loader such that said tines are adapted for engaging materials;

a plurality of arm assemblies being coupled to said base portion of said frame assembly, each of said arm assemblies being articulated such that each of said arm assemblies is positionable with respect to said frame assembly, each of said arm assemblies being adapted for being operationally coupled to the skid loader such that articulation of each of said arm assemblies is controlled by an operator of the skid loader, said arm assemblies being adapted for facilitating gathering, retaining and removing of materials engaged by said frame assembly;

a bucket portion being selectively coupled to said base portion of said frame assembly such that said bucket portion is positioned opposite the skid loader, said bucket portion being adapted for facilitating collecting of materials unable to be collected by said tines of said frame assembly;

said bucket portion having a plurality of tine sleeves, each of said tine sleeves receiving one of said tines of said frame assembly, each of said tines being for aiding in supporting said bucket portion when said bucket portion is coupled to said base portion of said frame assembly; and each of said tine sleeves being positioned along a bottom of said bucket portion, each of said tine sleeves being for positioning a free end of each of said tines under a leading edge of said bucket portion such that said free ends of said tines are for reinforcing said leading edge of said bucket portion when said leading edge is used to scrape materials into said bucket portion.

23. A skid loader attachment for facilitating collection and depositing materials with a skid loader, the skid loader attachment comprising:

a frame assembly having a base portion, said base portion being adapted for coupling to booms of the skid loader, said frame assembly having a plurality of tines, said tines forwardly extending from said base portion of said frame assembly opposite the skid loader such that said tines are adapted for engaging materials;

a plurality of arm assemblies being coupled to said base portion of said frame assembly, each of said arm assemblies being articulated such that each of said arm assemblies is positionable with respect to said frame assembly, each of said arm assemblies being adapted for being operationally coupled to the skid loader such that articulation of each of said arm assemblies is controlled by an operator of the skid loader, said arm assemblies being adapted for facilitating gathering, retaining and removing of materials engaged by said frame assembly;

a bucket portion being selectively coupled to said base portion of said frame assembly such that said bucket portion is positioned opposite the skid loader, said bucket portion being adapted for facilitating collecting of materials unable to be collected by said tines of said frame assembly; and said bucket portion having a plurality of alignment members, each of said alignment members being insertable within a lumen of one of a plurality of alignment sleeves of said frame assembly such that said alignment members are for facilitating alignment of said bucket portion with said frame assembly when said bucket portion is being coupled to said frame assembly.

24. A skid loader attachment for facilitating collection and depositing materials with a skid loader, the skid loader attachment comprising:

a frame assembly having a base portion, said base portion being adapted for coupling to booms of the skid loader, said frame assembly having a plurality of tines, said tines forwardly extending from said base portion of said frame assembly opposite the skid loader such that said tines are adapted for engaging materials;

a plurality of arm assemblies being coupled to said base portion of said frame assembly, each of said arm assemblies being articulated such that each of said arm assemblies is positionable with respect to said frame assembly, each of said arm assemblies being adapted for being operationally coupled to the skid loader such that articulation of each of said arm assemblies is controlled by an operator of the skid loader, said arm assemblies being adapted for facilitating gathering, retaining and removing of materials engaged by said frame assembly;

a bucket portion being selectively coupled to said base portion of said frame assembly such that said bucket portion is positioned opposite the skid loader, said bucket portion being adapted for facilitating collecting of materials unable to be collected by said tines of said frame assembly;

said bucket portion having a plurality of locking bars, each of said locking bars being received by one of a plurality of locking assemblies of said frame assembly, each of said locking assemblies being for securing said bucket portion to said frame assembly when each said locking assemblies receives one of said locking bars of said bucket portion; and each of said locking assemblies of said frame assembly having an interior sleeve and an exterior sleeve, said interior sleeve being positioned within said exterior sleeve such that said interior sleeve is rotatable with respect to said exterior sleeve, said interior sleeve having an opening through said interior sleeve for permitting access to a lumen of said interior sleeve, said opening of said interior sleeve being alignable with a gap of said exterior sleeve such that one of said locking bars of said bucket portion is insertable through said gap of said exterior sleeve and said opening of said interior sleeve into said lumen of said interior sleeve, said interior sleeve being rotated with respect to said exterior sleeve for misaligning said opening of said interior sleeve and said gap of said exterior sleeve for securing one of said locking bars of said bucket portion within said lumen of said interior sleeve.

25. A skid loader attachment for facilitating collection and depositing materials with a skid loader, the skid loader attachment comprising:

a frame assembly having a base portion, said base portion being adapted for coupling to booms of the skid loader, said frame assembly having a plurality of tines, said tines forwardly extending from said base portion of said frame assembly opposite the skid loader such that said tines are adapted for engaging materials;

a plurality of arm assemblies being coupled to said base portion of said frame assembly, each of said arm assemblies being articulated such that each of said arm assemblies is positionable with respect to said frame assembly, each of said arm assemblies being adapted for being operationally coupled to the skid loader such that articulation of each of said arm assemblies is controlled by an operator of the skid loader, said arm assemblies being adapted for facilitating gathering, retaining and removing of materials engaged by said frame assembly;

an attachment assembly being selectively coupled to said arm assemblies, said attachment assembly having a base member being coupled to said arm assemblies, said attachment assembly being adapted for facilitating collection and depositing of materials;

said attachment assembly having a blade portion, said blade portion being coupled to said base member such that said blade portion extends towards said frame assembly, said blade assembly being adapted for facilitating accumulation and discharging of material with respect to said frame assembly; and said blade portion of said attachment assembly comprising a flexible material, said flexible material of said blade portion permitting scraping of said material from said frame assembly.

26. A skid loader attachment for facilitating collection and depositing materials with a skid loader, the skid loader attachment comprising:

a frame assembly having a base portion, said base portion being adapted for coupling to booms of the skid loader, said frame assembly having a plurality of tines, said tines forwardly extending from said base portion of said frame assembly opposite the skid loader such that said tines are adapted for engaging materials;

a plurality of arm assemblies being coupled to said base portion of said frame assembly, each of said arm assemblies being articulated such that each of said arm assemblies is positionable with respect to said frame assembly, each of said arm assemblies being adapted for being operationally coupled to the skid loader such that articulation of each of said arm assemblies is controlled by an operator of the skid loader, said arm assemblies being adapted for facilitating gathering, retaining and removing of materials engaged by said frame assembly;

an attachment assembly being selectively coupled to said arm assemblies, said attachment assembly having a base member being coupled to said arm assemblies, said attachment assembly being adapted for facilitating collection and depositing of materials; and said attachment assembly having a brush member, said brush member being rotatably coupled to said base member of said attachment assembly, a motor assembly being operationally coupled to said brush member such that said motor assembly rotates said brush member with respect to said base member of said attachment assembly, said brush member being adapted for brushing material into and out of said frame assembly.

27. A skid loader attachment for facilitating collection and depositing materials with a skid loader, the skid loader attachment comprising:

a frame assembly having a base portion, said base portion being adapted for coupling to booms of the skid loader, said frame assembly having a plurality of tines, said tines forwardly extending from said base portion of said frame assembly opposite the skid loader such that said tines are adapted for engaging materials;

a plurality of arm assemblies being coupled to said base portion of said frame assembly, each of said arm assemblies being articulated such that each of said arm assemblies is positionable with respect to said frame assembly, each of said arm assemblies being adapted for being operationally coupled to the skid loader such that articulation of each of said arm assemblies is controlled by an operator of the skid loader, said arm assemblies being adapted for facilitating gathering, retaining and removing of materials engaged by said frame assembly;

an attachment assembly being selectively coupled to said arm assemblies, said attachment assembly having a base member being coupled to said arm assemblies, said attachment assembly being adapted for facilitating collection and depositing of materials; and said attachment assembly having a plurality of fingers, each of said fingers being coupled to said base member of said attachment assembly, each of said fingers being adapted for facilitating collection and removal of the material with respect to said frame assembly.

* * * * *